US009553392B2

(12) United States Patent
Thelen

(10) Patent No.: US 9,553,392 B2
(45) Date of Patent: Jan. 24, 2017

(54) ELECTRICAL PLUG CONNECTOR HAVING A PLUG-CONNECTION MEMBER AND A CABLE OUTLET MEMBER

(71) Applicant: Telegaertner Karl Gaertner GmbH, Steinenbronn (DE)

(72) Inventor: Maik Thelen, Holzgerlingen (DE)

(73) Assignee: Telegaertner Karl Gaertner GmbH, Steinenbronn (DE)

( * ) Notice: Subject to any disclaimer, the term of this patent is extended or adjusted under 35 U.S.C. 154(b) by 0 days.

(21) Appl. No.: 14/659,683

(22) Filed: Mar. 17, 2015

(65) Prior Publication Data

US 2015/0280349 A1 Oct. 1, 2015

(30) Foreign Application Priority Data

Mar. 28, 2014 (DE) ..... 10 2014 104 449

(51) Int. Cl.

| | |
|---|---|
| ***H01R 13/56*** | (2006.01) |
| ***H01R 13/502*** | (2006.01) |
| ***H01R 13/58*** | (2006.01) |
| *H01R 35/02* | (2006.01) |
| *H01R 13/506* | (2006.01) |

(52) U.S. Cl.

CPC ..... *H01R 13/502* (2013.01); *H01R 13/5812* (2013.01); *H01R 13/5841* (2013.01); *H01R 13/506* (2013.01); *H01R 13/567* (2013.01); *H01R 35/02* (2013.01)

(58) Field of Classification Search

CPC ... H01R 35/02; H01R 13/5841; H01R 13/567; H01R 13/506

USPC ..... 439/446, 694, 902, 855, 881

See application file for complete search history.

(56) References Cited

U.S. PATENT DOCUMENTS

| | | | |
|---|---|---|---|
| 4,005,922 | A | 2/1977 | Burkhart et al. |
| 4,023,879 | A | 5/1977 | Braund et al. |
| 4,030,741 | A | 6/1977 | Fidrych |
| 4,070,085 | A | 1/1978 | Nelson |
| 4,114,974 | A | 9/1978 | Lawrence |
| 4,553,111 | A | 11/1985 | Barrow |
| 4,560,962 | A | 12/1985 | Barrow |
| 4,641,905 | A | 2/1987 | Poliak et al. |
| 4,653,836 | A | 3/1987 | Peele |
| 4,671,598 | A | 6/1987 | Keehne |

(Continued)

FOREIGN PATENT DOCUMENTS

| | | |
|---|---|---|
| AT | 408 820 | 10/2008 |
| CN | 101944692 | 1/2011 |

(Continued)

*Primary Examiner* — Tho D Ta

(74) *Attorney, Agent, or Firm* — Lipsitz & McAllister, LLC

(57) ABSTRACT

An electrical plug connector with a plug-connection member and with an angled cable outlet member is provided. The cable outlet member is able to be connected detachably to the plug-connection member in a plurality of orientations. In order to develop the electrical plug connector such that it is simple to manipulate even when using relatively thick cables, it is proposed that the cable outlet member be able to be connected detachably to the plug-connection member by a pivoting movement about a pivot axis arranged obliquely or perpendicular to the longitudinal axis of the plug-connection member or by a linear movement along the longitudinal axis of the plug-connection member.

19 Claims, 8 Drawing Sheets

(56) References Cited

U.S. PATENT DOCUMENTS

| | | | |
|---|---|---|---|
| 4,935,093 | A | 6/1990 | Reeb |
| 4,990,094 | A | 2/1991 | Chandler et al. |
| 5,104,333 | A | 4/1992 | Hatagishi et al. |
| 5,178,554 | A | 1/1993 | Siemon et al. |
| 5,186,647 | A | 2/1993 | Denkmann et al. |
| 5,211,576 | A | 5/1993 | Tonkiss et al. |
| 5,295,869 | A | 3/1994 | Siemon et al. |
| 5,299,956 | A | 4/1994 | Brownell et al. |
| 5,300,734 | A | 4/1994 | Suzuki |
| 5,310,363 | A | 5/1994 | Brownell et al. |
| 5,326,284 | A | 7/1994 | Bohbot et al. |
| 5,362,257 | A | 11/1994 | Neal et al. |
| 5,391,095 | A | 2/1995 | Born |
| 5,414,393 | A | 5/1995 | Rose et al. |
| 5,432,484 | A | 7/1995 | Klas et al. |
| 5,435,752 | A | 7/1995 | Siemon et al. |
| 5,439,388 | A | 8/1995 | Weiss et al. |
| 5,488,201 | A | 1/1996 | Liu |
| 5,586,914 | A | 12/1996 | Foster, Jr. et al. |
| 5,647,767 | A | 7/1997 | Scheer et al. |
| 5,700,167 | A | 12/1997 | Pharney et al. |
| 5,941,734 | A | 8/1999 | Ikeda et al. |
| 5,967,853 | A | 10/1999 | Hashim |
| 5,971,796 | A | 10/1999 | Duhr |
| 6,010,354 | A | 1/2000 | Cunningham |
| 6,083,031 | A | 7/2000 | Kuo |
| 6,089,923 | A | 7/2000 | Phommachanh |
| 6,095,852 | A | 8/2000 | Gregory, II |
| 6,116,945 | A | 9/2000 | Davis et al. |
| 6,123,572 | A | 9/2000 | Ishii et al. |
| 6,139,355 | A | 10/2000 | Puerner |
| 6,149,455 | A | 11/2000 | Levi |
| 6,157,542 | A | 12/2000 | Wu |
| 6,165,023 | A | 12/2000 | Troutman et al. |
| 6,179,667 | B1 | 1/2001 | Espenshade et al. |
| 6,305,950 | B1 | 10/2001 | Doorhy |
| 6,319,070 | B1 | 11/2001 | Tan |
| 6,333,472 | B1 | 12/2001 | Weatherley |
| 6,371,793 | B1 | 4/2002 | Doorhy et al. |
| 6,379,157 | B1 | 4/2002 | Curry et al. |
| 6,394,844 | B1 | 5/2002 | Frias Valero et al. |
| 6,416,364 | B1 | 7/2002 | Shi et al. |
| 6,464,541 | B1 | 10/2002 | Hashim et al. |
| 6,497,588 | B1 | 12/2002 | Scharf et al. |
| 6,508,669 | B2 | 1/2003 | Wang |
| 6,520,808 | B2 | 2/2003 | Forbes et al. |
| 6,558,185 | B1 | 5/2003 | Stockel et al. |
| 6,579,128 | B1 | 6/2003 | Wu |
| 6,648,674 | B1 | 11/2003 | Dobler |
| 6,684,179 | B1 | 1/2004 | David |
| 6,840,779 | B2 | 1/2005 | Eberle et al. |
| 6,966,798 | B1 | 11/2005 | Wu |
| 7,040,925 | B2 | 5/2006 | Beerwerth et al. |
| 7,249,979 | B2 | 7/2007 | Gerber et al. |
| 7,304,241 | B2 | 12/2007 | Trieb et al. |
| 7,396,251 | B2 | 7/2008 | Kuo |
| 7,540,789 | B2 | 6/2009 | Gerber et al. |
| 7,559,790 | B2 | 7/2009 | Boeck et al. |
| 7,578,695 | B2 | 8/2009 | Boeck et al. |
| 7,604,515 | B2 | 10/2009 | Siemon et al. |
| 7,621,674 | B2 | 11/2009 | Szilagyi |
| 7,641,503 | B1 | 1/2010 | van der Horn et al. |
| 7,641,504 | B1 | 1/2010 | Padruzzi |
| 7,689,089 | B2 | 3/2010 | Wagner et al. |
| 7,815,445 | B2 | 10/2010 | Wu et al. |
| 7,938,674 | B2 | 5/2011 | Lindkamp et al. |
| 7,988,476 | B2 | 8/2011 | Billman et al. |
| 8,040,692 | B2 | 10/2011 | Hetzer et al. |
| 8,182,285 | B2 | 5/2012 | Annequin et al. |
| 8,192,224 | B2 | 6/2012 | Schmidt et al. |
| 8,246,377 | B2 | 8/2012 | Lindkamp et al. |
| 8,262,406 | B2 | 9/2012 | Lindkamp |
| 8,298,922 | B2 | 10/2012 | Schumann et al. |
| 8,376,779 | B2 | 2/2013 | Metral et al. |
| 8,435,065 | B2 | 5/2013 | Littek et al. |
| 8,814,598 | B2 | 8/2014 | Hein et al. |
| 9,130,283 | B1 * | 9/2015 | Lin ..... H01R 4/2433 |
| 9,325,163 | B2 | 4/2016 | Pelletier |
| 2002/0009930 | A1 | 1/2002 | Chang |
| 2002/0025713 | A1 | 2/2002 | Tabata |
| 2002/0146930 | A1 | 10/2002 | Williams |
| 2003/0157842 | A1 | 8/2003 | Arnett et al. |
| 2003/0171024 | A1 | 9/2003 | Mossner et al. |
| 2004/0203292 | A1 | 10/2004 | Eberle et al. |
| 2004/0209523 | A1 | 10/2004 | Milner et al. |
| 2005/0118881 | A1 | 6/2005 | Aekins et al. |
| 2005/0136747 | A1 | 6/2005 | Caveney et al. |
| 2005/0153580 | A1 | 7/2005 | Schilling |
| 2005/0159036 | A1 | 7/2005 | Caveney et al. |
| 2005/0176302 | A1 | 8/2005 | Beerwerth et al. |
| 2006/0060374 | A1 | 3/2006 | Trieb et al. |
| 2006/0183359 | A1 | 8/2006 | Gerber et al. |
| 2007/0190656 | A1 | 8/2007 | Crain et al. |
| 2007/0202752 | A1 | 8/2007 | Schumann et al. |
| 2008/0057793 | A1 | 3/2008 | Gerber et al. |
| 2008/0096417 | A1 | 4/2008 | Boeck et al. |
| 2008/0188120 | A1 | 8/2008 | Tsuji |
| 2008/0200059 | A1 | 8/2008 | Boeck et al. |
| 2009/0147495 | A1 | 6/2009 | Hetzer et al. |
| 2010/0015858 | A1 | 1/2010 | Gerber et al. |
| 2010/0233900 | A1 | 9/2010 | Gimbel |
| 2010/0279529 | A1 | 11/2010 | Ng Vern Shen et al. |
| 2011/0065309 | A1 | 3/2011 | Lindkamp et al. |
| 2011/0070766 | A1 | 3/2011 | Lindkamp et al. |
| 2011/0117770 | A1 | 5/2011 | Lindkamp |
| 2011/0212652 | A1 | 9/2011 | Schmidt et al. |
| 2011/0300740 | A1 | 12/2011 | Schumann et al. |

FOREIGN PATENT DOCUMENTS

| | | |
|---|---|---|
| DE | 84 15 489 | 8/1984 |
| DE | 34 39 629 | 4/1986 |
| DE | 9216186 | 3/1993 |
| DE | 691 15 863 | 5/1996 |
| DE | 196 49 668 | 5/1998 |
| DE | 200 12 572 | 2/2001 |
| DE | 199 38 367 | 3/2001 |
| DE | 100 51 097 | 3/2002 |
| DE | 102 42 143 | 3/2004 |
| DE | 10 2005 038 540 | 1/2007 |
| DE | 10 2006 049 563 | 4/2008 |
| DE | 10 2007 008 465 | 8/2008 |
| DE | 10 2007 029 593 | 1/2009 |
| DE | 10 2008 064 535 | 6/2010 |
| EP | 0577035 | 1/1994 |
| EP | 0 982 815 | 3/2000 |
| EP | 1 096 620 | 5/2001 |
| EP | 1 693 933 | 8/2006 |
| EP | 2045884 | 4/2009 |
| EP | 2 299 547 | 3/2011 |
| EP | 2 302 743 | 3/2011 |
| EP | 2 323 228 | 5/2011 |
| EP | 2426786 | 3/2012 |
| GB | 2 120 021 | 11/1983 |
| GB | 2 157 900 | 10/1985 |
| JP | S54-79990 | 11/1952 |
| JP | S61-65677 | 5/1986 |
| JP | S62-173181 | 11/1987 |
| JP | 2001520799 | 10/2001 |
| JP | 2003504824 | 2/2003 |
| JP | 2005235547 | 9/2005 |
| JP | 2012508952 | 4/2012 |
| WO | 99/40651 | 8/1999 |
| WO | 02/17442 | 2/2002 |
| WO | WO 02/17442 | 2/2002 |
| WO | 2008/025180 | 3/2008 |
| WO | WO 2008/025180 | 3/2008 |

* cited by examiner

ELECTRICAL PLUG CONNECTOR HAVING A PLUG-CONNECTION MEMBER AND A CABLE OUTLET MEMBER

This application claims the benefit of German application number 10 2014 104 449.5 filed on Mar. 28, 2014, which is incorporated herein by reference in its entirety and for all purposes.

BACKGROUND OF THE INVENTION

The invention relates to an electrical plug connector with a plug-connection member which can be plug-connected with a complementarily configured plug-connection member in order to produce an electrical connection and which has a longitudinal axis, and with a cable outlet member which has a cable guidance channel with a front channel section facing the plug-connection member and oriented in alignment with the longitudinal axis of the plug-connection member and with a rear channel section remote from the plug-connection member and oriented at an angle to the longitudinal axis of the plug-connection member, the cable outlet member being able to be connected detachably to the plug-connection member in a plurality of orientations.

Electrical plug connectors of this type are used for example to produce an electrical connection between a first cable and a second cable, or alternatively to produce an electrical connection between a first cable and an electrical appliance. To this end, a plug-connection member of the plug connector can be plug-connected with a complementarily configured plug-connection member. The plug-connection member may for example be formed as a connecting plug which can be inserted into a connecting socket, or alternatively as a connecting socket into which a connecting plug can be inserted. A cable may be guided through to the plug-connection member through a cable guidance channel of the cable outlet member. The cable guidance channel has a front channel section facing the plug-connection member and a rear channel section remote from the plug-connection member. In order to keep the overall length of the electrical plug connector as low as possible, the rear channel section is oriented at an angle to the front channel section. The cable which is passed through the cable guidance channel thus undergoes curvature in the cable guidance channel in the region between the front channel section and the rear channel section.

The cable outlet member can be connected detachably to the plug-connection member, it being able to be connected detachably to the plug-connection member in a plurality of orientations, so that the rear channel section can assume different angular positions relative to the longitudinal axis of the plug-connection member and thus the cable can be guided in different directions.

An electrical plug connector with an insulating body and an angled strain relief element is known from publication EP 2 323 228 A2. The insulating body is provided with a square collar which has a circumambient recess with latching cut-outs. The angled strain relief element has a matching connection opening and also a U-shaped rail which surrounds the connection opening on three sides. The rail has latching noses and latching hooks, and may be inserted into the recess of the isolating body, transversely to the longitudinal axis of the insulating body in four different orientations, which are each arranged at an angle of 90° offset relative to each other.

Pushing on the rail of the strain relief element transversely to the longitudinal axis of the insulating body frequently proves quite difficult, in particular when using relatively thick cables.

It is an object of the present invention to improve an electrical plug connector of the generic type such that it is easy to manipulate even when using relatively thick cables.

SUMMARY OF THE INVENTION

This object is achieved in an electrical plug connector of the type referred to first hereinbefore according to the invention in that the cable outlet member can be connected detachably to the plug-connection member by a pivoting movement about a pivot axis arranged obliquely or perpendicular to the longitudinal axis of the plug-connection member or by a linear movement along the longitudinal axis of the plug-connection member.

Due to the pivoting of the cable outlet member about a pivot axis oriented obliquely or preferably perpendicular to the longitudinal axis of the plug-connection member or alternatively by a linear movement along the longitudinal axis of the plug-connection member, the cable outlet member can be connected detachably to the plug-connection member in a very simple manner. Manipulation proves easy, in particular also when using relatively thick cables which can be bent only with considerable application of force.

The plug-connection member usually has a connection module to which the individual strands of the cable can be connected. Such connection modules are frequently also referred to as "wire managers". The connection module can be introduced into the plug-connection member in the longitudinal direction of the plug-connection member, and the connection module upon producing the connection between the plug-connection member and the cable outlet member can be transferred into its end position by a pivoting movement of the cable outlet member or alternatively by a linear movement of the cable outlet member in the direction of the longitudinal axis of the plug-connection member. This results in further simplification of the manipulation of the electrical plug connector.

The rear channel section of the cable guidance channel is oriented at an angle to the front channel section of the cable guidance channel. It is beneficial if the angle between the front channel section and the rear channel section is at least 45°. Beneficially, the angle between the front channel section and the rear channel section is 45° to 90°. In a particularly preferred configuration, the rear channel section is oriented perpendicular to the front channel section. This provides the electrical plug connector with a particularly short overall length.

In an advantageous embodiment of the invention, the electrical plug connector has at least one locking member for detachably locking the cable outlet member on the plug-connection member. The locking member is movable back and forth between a release position and a locking position. When producing the connection between the cable outlet member and the plug-connection member, the locking member can assume its release position, and once connection of the cable outlet member to the plug-connection member has taken place the locking member can be transferred into its locking position, in which it secures the cable outlet member to the plug-connection member.

The locking member is beneficially pivotable about a pivot axis oriented obliquely or perpendicular to the longitudinal axis of the plug-connection member. Alternatively, provision may be made for the locking member to be linearly displaceable perpendicular to the longitudinal axis of the plug-connection member.

Preferably the locking member is mounted on the plug-connection member.

It is particularly advantageous if the locking member can be latched in a locking position. For this purpose, the locking member preferably has at least one first latch element which in the locking position of the locking member cooperates with a second latch element to produce a latch connection. For example, at least one latching nose may be arranged on the locking member, which nose in the locking position of the locking member penetrates into an associated latch recess.

As has already been mentioned, the cable outlet member can be connected detachably to the plug-connection member in a plurality of different orientations. It is beneficial if the electrical plug connector has a plurality of first connecting elements which are located diametrically opposed to one another in pairs, and if the electrical plug connector has two second connecting elements which are located diametrically opposed to one another, with one pair of the first connecting elements in each case being able to be connected detachably to the second connecting elements in the individual orientations of the cable outlet member.

Provision may for example be made for the electrical plug connector to have two pairs of first connecting elements which are arranged offset by 90° to each other relative to the longitudinal axis of the plug-connection member. This gives the user the possibility of connecting the cable outlet member detachably to the plug-connection member in a total of four orientations each arranged offset by 90° to each other.

In an advantageous configuration of the invention, the pairs of first connecting elements are arranged on the cable outlet member and the two second connecting elements are arranged on the plug-connection member.

It is beneficial if the first connecting elements are arranged spaced apart from each other. The first connecting elements may for example be positioned on an end face of the cable outlet member facing the plug-connection member, the first connecting elements being formed in the manner of projections or depressions which are arranged spaced apart from each other in each case.

The second connecting elements are advantageously arranged spaced apart from each other. For example, provision may be made for the second connecting elements to be positioned on a rear side of the plug-connection member facing the cable outlet member, the plug-connection member having an opening, into or onto the edge of which the second connecting elements are formed.

It is advantageous if the first connecting elements are configured as connection lugs and the second connecting elements are configured as connection receptacles, one pair of connection lugs being able to be introduced into the connection receptacles in each orientation of the cable outlet member.

Preferably the connection lugs are configured to be rectangular.

Advantageously the connection lugs protrude from an end surface of the cable outlet member.

Preferably the connection lugs are oriented parallel to the longitudinal axis of the plug-connection member.

The connection receptacles in a preferred configuration of the invention are arranged on the inner side of a collar of the plug-connection member which faces the cable outlet member.

In order to produce a detachable connection, the connection lugs may be introduced into the connection receptacles, with the connection lugs being pivoted about a pivot axis oriented perpendicular to the longitudinal axis of the plug-connection member or displaced parallel to the longitudinal axis of the plug-connection member.

Preferably the connection lugs in each case have an aperture, and a projection is arranged in one of the connection receptacles, which projection, upon introduction of a connection lug into the connection receptacle, penetrates into the aperture. With such a configuration, thus a first connection receptacle may have a projection, and in a first assembly step a first connection lug may be hooked into the first connection receptacle, with the aperture of the first connection lug receiving the projection of the first connection receptacle. Then, in a second assembly step, the cable outlet member can be pivoted about a pivot axis oriented perpendicular to the longitudinal axis of the plug-connection member to such an extent that a second connection lug which is located diametrically opposed to the first connection lug can be pivoted into a second connection receptacle which is located diametrically opposed to the first connection receptacle. The production of a connection between the cable outlet member and the plug-connection member proves particularly simple with such a configuration.

It is beneficial if the locking member already discussed above has a bar which can be introduced into a connection receptacle. If a connection lug with an aperture has been introduced into this connection receptacle beforehand, the connection lug can then be secured in the connection receptacle by means of the bar of the locking member.

It is particularly advantageous if one connection receptacle has a delimitation in the form of a circular arc. The circular arc delimitation forms a wall of the connection receptacle. A connection lug can be guided into the connection receptacle upon pivoting-in along the circular arc delimitation.

Further simplification of the manipulation of the electrical plug connector is achieved in an advantageous embodiment in that the cable outlet member has a first and a second housing shell, the first housing shell being able to be connected detachably to the plug-connection member in various orientations and the second housing shell being movable between an open position which releases the first housing shell and a closed position which covers the first housing shell. The cable is thus received by the two housing shells, the cable being bent in the desired manner upon the transfer of the second housing shell from its open position into its closed position.

Beneficially, the second housing shell is held non-detachably on the first housing shell.

It is advantageous if the second housing shell is mounted on the first housing shell so that it can be moved back and forth between the open position and the closed position.

The second housing shell is beneficially pivotable about a pivot axis oriented obliquely or perpendicular to the longitudinal axis of the plug-connection member.

Provision may be made for the second housing shell to be mounted on the first housing shell so as to be pivotable with the aid of a hinge. The hinge may have two hinge pins oriented perpendicular to the longitudinal axis of the plug-connection member which are arranged on two outer sides of the first housing shell which are remote from each other. Beneficially, the hinge pins are connected in one part to the first housing shell.

In a further advantageous configuration, the cable outlet member has a cap nut which can be screwed onto the two housing shells. This, in a structurally simple manner, yields the possibility of securing the second housing shell in its closed position on the first housing shell. The second housing shell, in combination with the first housing shell, may form an external thread onto which the cap nut can be screwed.

It is particularly advantageous if the two housing shells in combination with the cap nut form a strain-relief arrangement which secures the cable in the cable guidance channel of the cable outlet member.

Provision may for example be made for the two housing shells to have on their inner sides which face each other a projection which is directed radially inwards, which projection can be pressed against a cable arranged in the cable guidance channel by screwing the cap nut onto the two housing shells.

The description below of advantageous embodiments of the invention, in conjunction with the drawings, serves to explain the invention in greater detail.

DETAILED DESCRIPTION OF THE INVENTION

Figure 1:
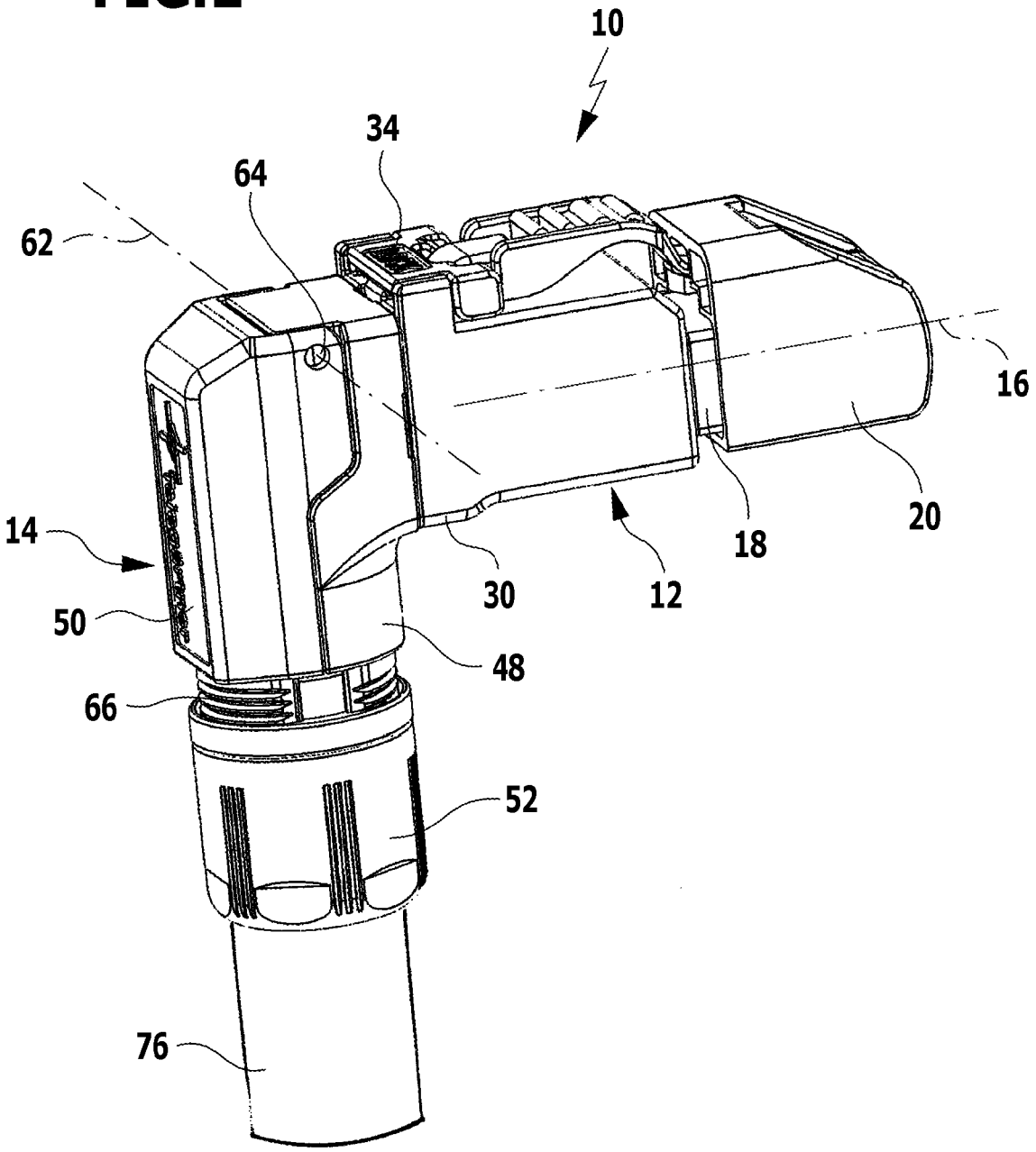
FIG. 1: shows a perspective view of a first advantageous embodiment of a plug connector according to the invention with a plug-connection member and a cable outlet member.

FIGS. 1 to 9 show diagrammatically a first advantageous embodiment of an electrical plug connector according to the invention which is assigned overall the reference numeral 10. The electrical plug connector 10 has a plug-connection member 12 and a cable outlet member 14. The plug-connection member 12 is configured at its front end section 18 as a connecting plug which has a plurality of electrical contact elements which are known per se, which in the example of embodiment illustrated are covered by a protective cap 20 in order to protect them against dirt and damage during transport. The protective cap 20 can be removed by the user in order to introduce the front end section 18 into an electrical connecting socket known to the person skilled in the art. Alternatively, provision may also be made for the front end section 18 to be designed as a connecting socket.

Figure 2:
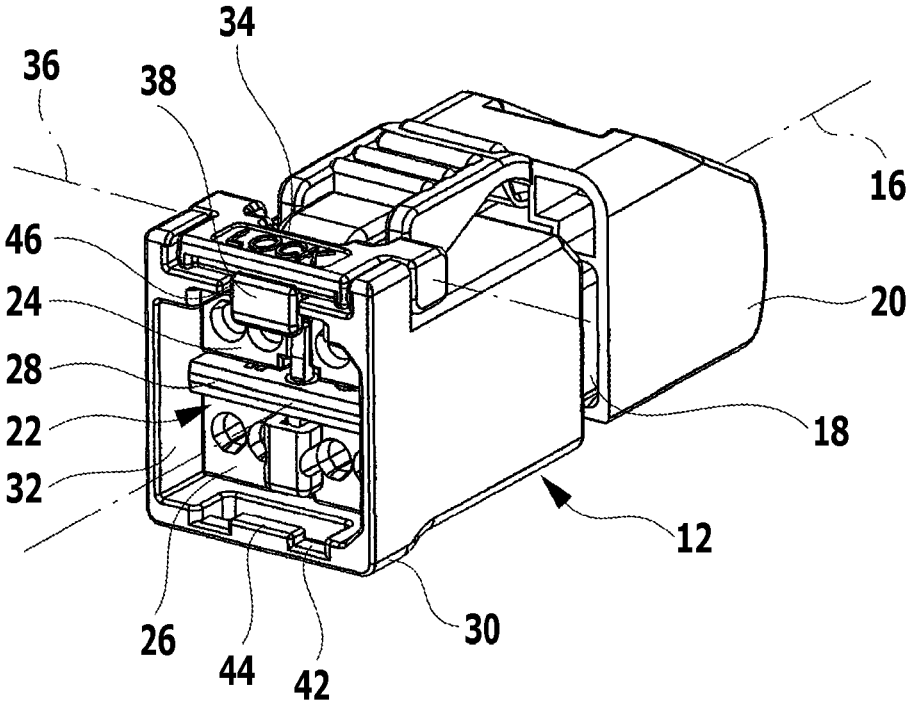
FIG. 2: shows a perspective view of the plug-connection member of the electrical plug connector of FIG. 1.
Figure 3:
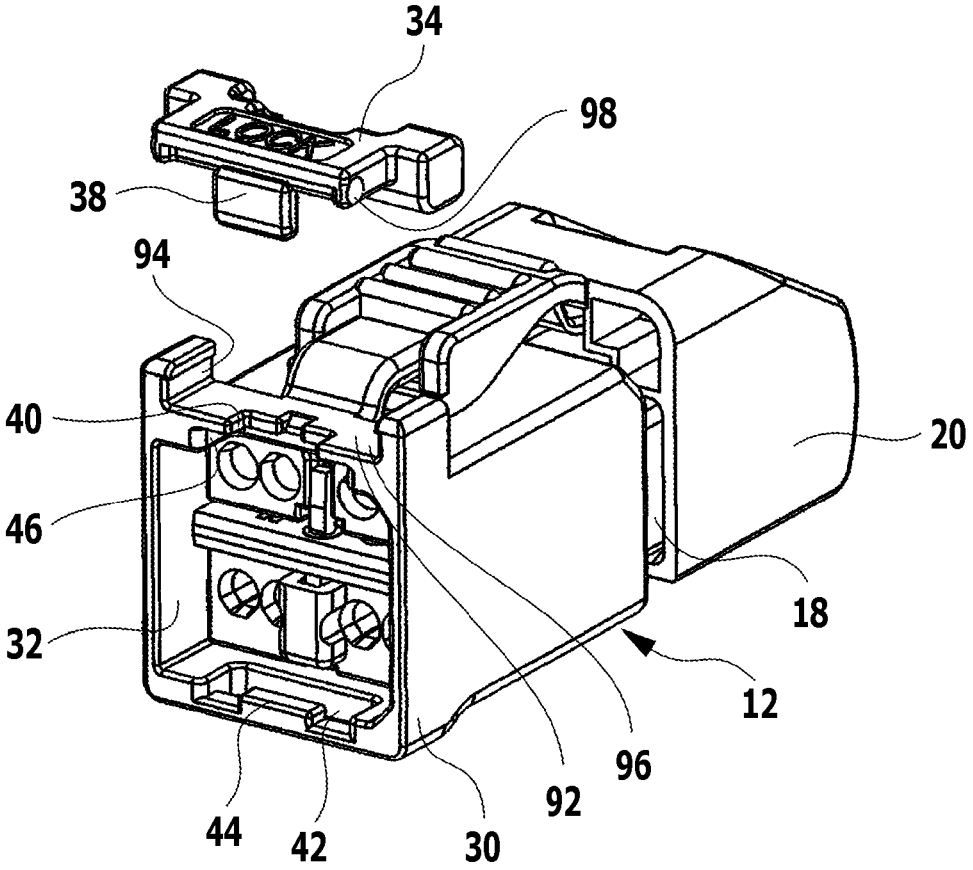
FIG. 3: shows a perspective view of the plug-connection member of FIG. 1 in the manner of an exploded view.
Figure 4:
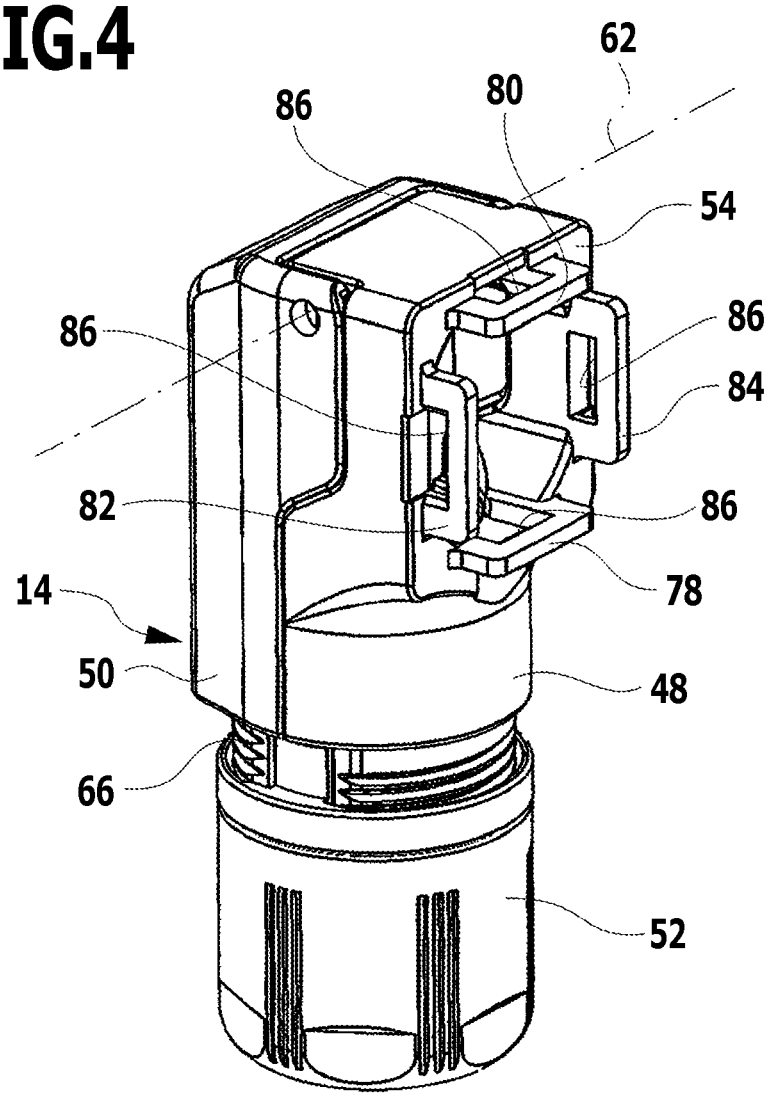
FIG. 4: shows a perspective view of the cable outlet member of the electrical plug connector of FIG. 1.

As becomes clear in particular from FIGS. 2 and 3, the plug-connection member 12 receives a connection module 22 with an upper connection block 24 and a lower connection block 26, between which an electrical printed circuit board 28 is arranged and to which the individual strands of an electric cable can be connected. Connection modules 22 of this type are known to the person skilled in the art for example from DE 10 2008 064 535 A1.

On its rear side remote from the front end section 18, the plug-connection member 12 has a collar 30 which surrounds an opening 32. On an outer side of the collar 30, a locking member 34 is mounted on the plug-connection member 12 so as to be pivotable about a locking axis 36 oriented perpendicular to the longitudinal axis 16 of the plug-connection member 12. The locking member 34 has a bar 38, and is pivotable back and forth between a locking position illustrated in FIGS. 1, 2 and 8 and a release position illustrated in FIGS. 5, 6, 7 and 9.

The collar 30 has, facing the locking member 34, an opening 40 through which the bar 38 extends in the locking position of the locking member 34.

On the side remote from the bar 38, a first connecting element in the form of a first connection receptacle 42 is formed into the inner side of the collar 30, in which inner side a projection 44 which is directed radially inwards is arranged. A second connection receptacle 46 is located diametrically opposed to the first connection receptacle 42. The opening 40 opens into the second connection receptacle 46, and in the locking position the bar 38 penetrates into the second connection receptacle 46.

The cable outlet member 14 has a first housing shell 48, a second housing shell 50 and also a cap nut 52. The first housing shell 48 lies with one end face 54 against the collar 30 of the plug-connection member 12 and defines a front channel section 56 of a cable guidance channel 58, which section is oriented coaxially to the longitudinal axis 16 of the plug-connection member 12, and which extends through the cable outlet member 14. The front channel section 56 is adjoined by a rear channel section 60 which is remote from the plug-connection member 12 and is oriented perpendicular to the front channel section 56. Vertical orientation of the rear channel section 60 relative to the front channel section 56 is however not absolutely necessary. Provision may also be made for the rear channel section to be oriented at a different angle relative to the front channel section 56, in particular at an angle of at least 45°.

The second housing shell 50 is mounted on the first housing shell 48 so as to be pivotable about a housing pivot axis 62. The housing pivot axis 62 is oriented perpendicular to the longitudinal axis 16 of the plug-connection member 12 and parallel to the locking axis 36 of the locking member 34. The second housing shell 50 is mounted on the first housing shell 48 with the aid of a hinge which has two pivot pins which are oriented in alignment with each other and are formed on the outside onto the first housing shell 48, with merely one pivot pin 64 being able to be seen in the drawing. The second housing shell 50 can be pivoted back and forth between an open position illustrated in FIG. 5 and a closed position illustrated in FIG. 4. In its closed position, the second housing shell 50 together with the first housing shell 48 defines the rear channel section 60 of the cable guidance channel 58.

The two housing shells 48, 50 are configured approximately semi-cylindrically in their end regions which are remote from the plug-connection member 12, and together form an external thread 66 of the cable outlet member 14 onto which the cap nut 52 can be screwed.

In their end regions remote from the plug-connection member 12, the two housing shells 48, 50 have in each case a projection 68, 70, which extends in the peripheral direction along a partial region of the rear channel section 60, with a wedge surface 72, 74 directed into the rear channel section 60. The two projections 68, 70 in combination with the cap nut 52 form a strain-relief arrangement into which a cable 76 illustrated in FIG. 1 can be clamped. The cable 76 extends through the cable guidance channel 58, being bent by 90° in the region between the rear channel section 60 and the front channel section 56. The individual strands of the cable 76 are connected to the connection blocks 24 and 26 of the connection module 22.

To connect the strands of the cable 76 to the connection module 22, the cable 76 can be guided through the cable guidance channel 58 and then the individual strands can be connected to the connection blocks 24, 26. Thereafter, the connection module 22 can be introduced through the opening 32 into the plug-connection member 12. In a further assembly step, the cable outlet member 14 through which the cable 76 extends can then be connected to the plug-connection member 12. A first pair of connection lugs 78, 80 and a second pair of connection lugs 82, 84 are formed onto the end face 54 of the first housing shell 48 for this purpose, which pairs protrude from the end face 54, which is flat, perpendicularly in the direction of the plug-connection member 12. The connection lugs 78, 80, 82 and 84 are oriented parallel to the longitudinal axis 16 of the plug-connection member 12. The connection lugs 78, 80 are located diametrically opposed to one another relative to the longitudinal axis 16, and correspondingly the connection lugs 82, 84 of the second pair are located diametrically opposed to one another relative to the longitudinal axis 16. The second pair of connection lugs 82, 84 is arranged turned by an angle of 90° relative to the first pair of connection lugs 78, 80.

The use of a total of four connection lugs, two of which in each case are located opposite each other in pairs, makes it possible for the user to connect the cable outlet member 14 detachably to the plug-connection member 12 in four orientations which are offset by 90° relative to each other in each case. To this end, the user, in a first connection step, can hook one of the connection lugs, for example the connection lug 78, into the first connection receptacle 42. All the connection lugs 78, 80, 82, 84 have for this purpose an aperture 86 into which the projection 44 of the first connection receptacle 42 can penetrate.

Figure 5:
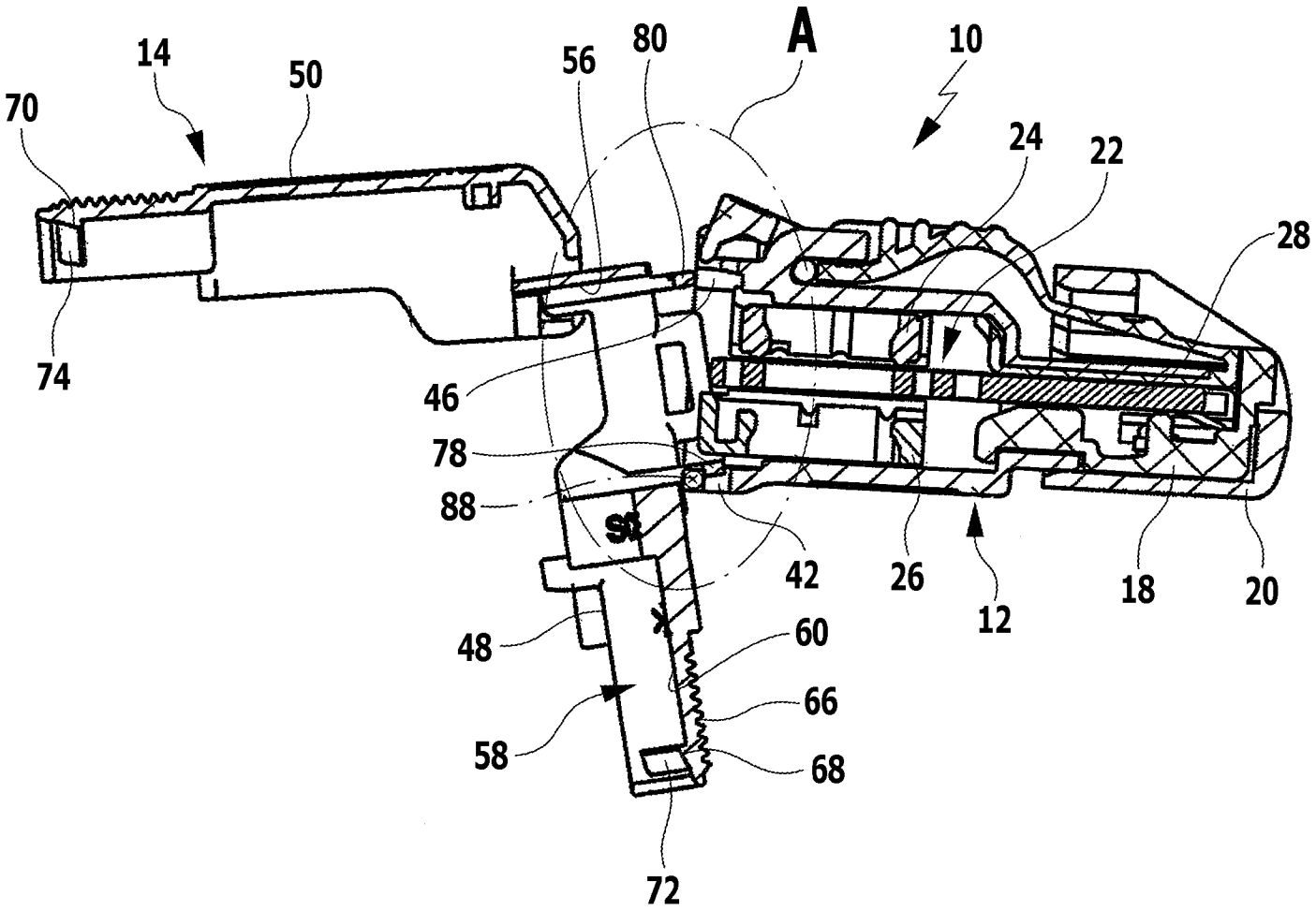
FIG. 5: shows a longitudinal sectional view of the electrical plug connector of FIG. 1, with a second housing shell of the cable outlet member assuming an open position and a first connection lug of the cable outlet member being hooked into a first connection receptacle of the plug-connection member.
Figure 6:
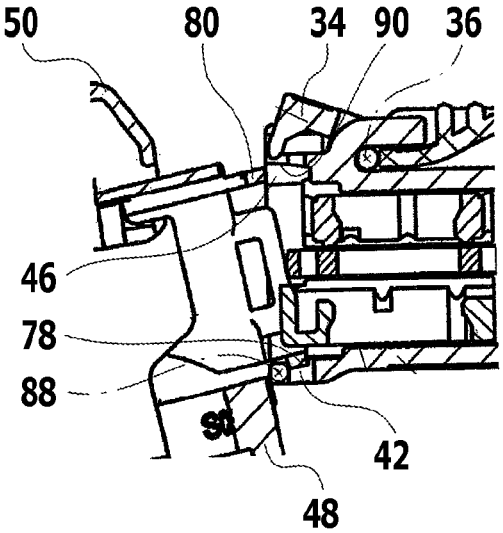
FIG. 6: shows an enlarged longitudinal sectional view of detail A of FIG. 5 upon hooking the first connection lug of the cable outlet member into the first connection receptacle of the plug-connection member.
Figure 7:
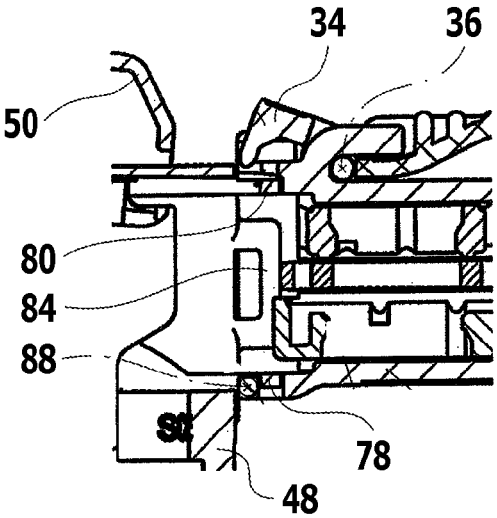
FIG. 7: shows an enlarged longitudinal sectional view corresponding to FIG. 6 once pivoting of the cable outlet member about a pivot axis oriented perpendicular to the longitudinal axis of the plug-connection member has taken place.
Figure 8:
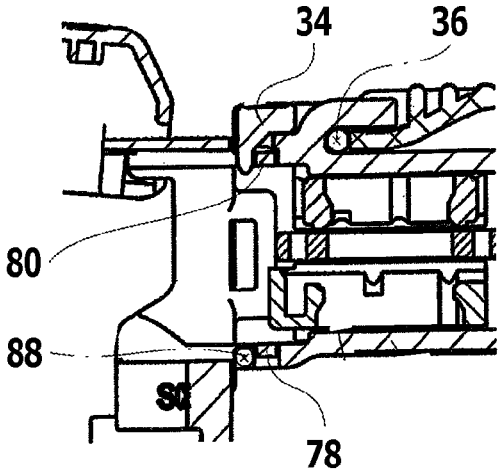
FIG. 8: shows an enlarged longitudinal sectional view corresponding to FIG. 6 once locking of the cable outlet member on the plug-connection member has taken place.

Once for example the connection lug 78 has been hooked into the first connection receptacle 42, as is illustrated in FIG. 5, the cable outlet member 14 can be pivoted about a pivot axis 88 oriented perpendicular to the longitudinal axis 16 of the plug-connection member 12 to such an extent that the connection lug 80 located diametrically opposed to the connection lug 78 which is hooked into the first connection receptacle 42 is pivoted into the second connection receptacle 46. The pivot axis 88 is oriented parallel to the side of the collar 30 into which the first connection receptacle 42 opens, and the wall 90 of the second connection receptacle 46 which is penetrated by the opening 40 of the collar 30 is formed in the manner of a circular arc, the partial circle defined by the wall 90 having its centre point on the pivot axis 88. Upon pivoting the connection lug 80 into the second connection receptacle 46, the connection lug 80 can slide along the arcuate wall 90.

In a subsequent connection step, the locking member 34, which has initially assumed its release position, can be pivoted into its locking position. In the locking position, the bar 38 extends through the aperture 86 of the connection lug 80 introduced into the second connection receptacle 46. The cable outlet member 14 is thereby secured to the plug-connection member 12.

The locking member 34 in its locking position penetrates into an outside recess 92 of the plug-connection member 12 which is delimited by two raised portions oriented parallel to the longitudinal axis 16 of the plug-connection member 12. The raised portions have in each case a latch recess 94, 96, into which one latch projection of the locking member 34 in each case engages in the locking position. A latch projection 98 of the locking member 34 can be seen in FIG. 3.

The locking member 34 can be secured in its locking position by means of the latch recesses 94, 96 and the latch projections 98. This prevents the cable outlet member 34 from unintentionally becoming detached from the plug-connection member 12.

Figure 9:
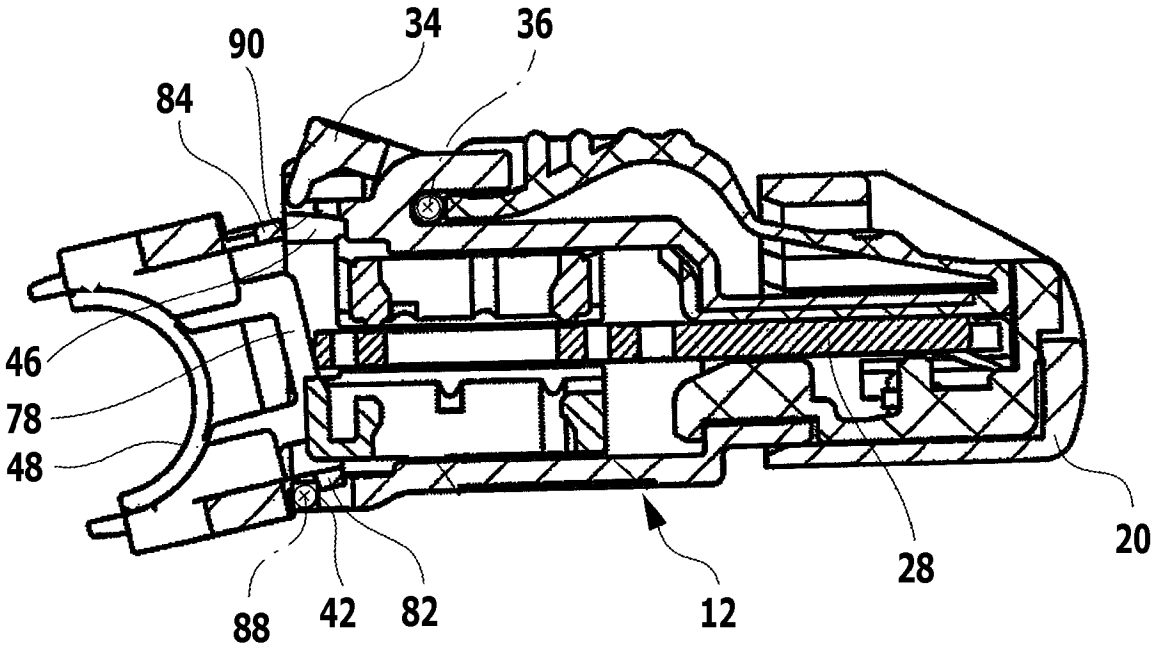
FIG. 9: shows a longitudinal sectional view corresponding to FIG. 5, the cable outlet member having an orientation rotated by 90° and the second housing shell having been removed to give a better overview.

As has already been mentioned, the cable outlet member 14 can be connected to the plug-connection member 12 in four different orientations by using the four connection lugs 78, 80, 82, 84. In FIG. 9, for this purpose the first housing shell 48 is illustrated diagrammatically in an orientation which is rotated by 90°. In this orientation too, the cable outlet member 14 can be connected to the plug-connection member 12 in a simple manner by a pivoting movement. In such case, initially one of the connection lugs 82, 84, for example the connection lug 82, is hooked into the first connection receptacle 42 and then the cable outlet member 14 is pivoted about the pivot axis 88 to such an extent that the connection lug 84 which is located diametrically opposed to the connection lug 82 penetrates into the second connection receptacle 46. Finally, the bar 38 of the locking member 34 can then extend through the aperture 86 of the connection lug 84 which has been introduced into the second connection receptacle 46, and thereby secure the cable outlet member 14 in the desired orientation on the plug-connection member 12.

Once the mechanical connection between the cable outlet member 14 and the plug-connection member 12 has been produced, the second housing shell 50 can be pivoted into its closed position, and finally the cap nut 52 can then be screwed onto the external thread 66 of the two housing shells 48, 50, the projections 68, 70 of the housing shells 48, 50 clamping the cable 76 between them.

Figure 10:
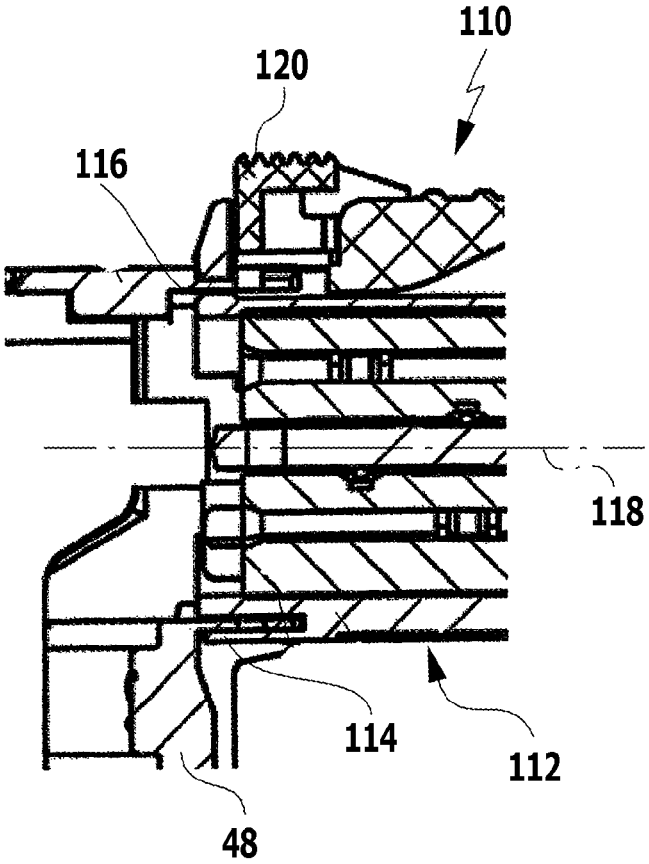
FIG. 10: shows an enlarged partial sectional view of a second advantageous embodiment of an electrical plug connector according to the invention once the insertion of connection lugs of the cable outlet member into associated connection receptacles of the plug-connection member has taken place.
Figure 11:
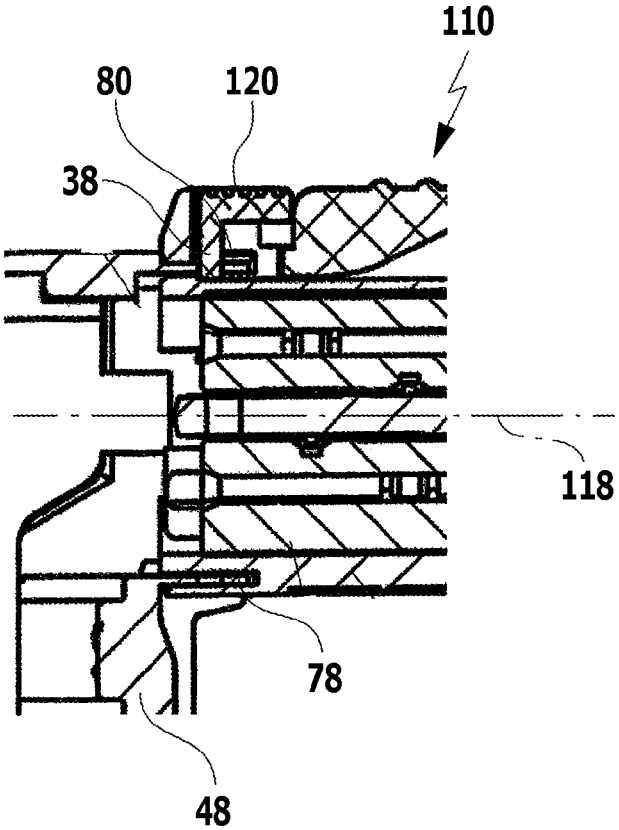
FIG. 11: shows an enlarged partial sectional view of the second advantageous embodiment of the invention once locking of the cable outlet member on the plug-connection member has taken place.

FIGS. 10 and 11 diagrammatically illustrate a second advantageous embodiment of an electrical plug connector in partial sectional views. The second advantageous embodiment in FIGS. 10 and 11 is assigned overall the reference numeral 110. The electrical plug connector 110 is configured largely identically to the electrical plug connector 10 described above with reference to FIGS. 1 to 9. Therefore, in FIGS. 10 and 11 the same reference numerals as in FIGS. 1 to 9 are used for identical components, and reference is made to the explanations above with respect to these components in order to avoid repetition.

In the case of the electrical plug connector 110 too, a cable outlet member 14 with a first housing shell 48 and a second housing shell 50 is used, with a total of four connection lugs 78, 80, 82, 84 being arranged on the end face 54 of the first housing shell 48, which lugs are located diametrically opposed to one another in pairs.

The electrical plug connector 110 has a plug-connection member 112 which comprises a first connection receptacle 114 and a second connection receptacle 116. The two connection receptacles 114, 116 are formed as receiving shafts which are oriented parallel to the longitudinal axis 118 of the plug-connection member 112.

In order to produce a mechanical connection between the first housing shell 48 of the electrical plug connector 110 and the plug-connection member 112, the first housing shell 48 together with the second housing shell 50 which is articulated to the first housing shell 48 can be moved colinearly to the longitudinal axis 118 in the direction of the plug-connection member 112, with either the connection lugs 78 and 80 or alternatively the connection lugs 82 and 84, depending on the orientation of the first housing shell 48, penetrating into the shaft-shaped connection receptacles 114, 116 of the plug-connection member 112.

A locking member 120 is used in order to lock the first housing shell 48 on the plug-connection member 112, which locking member can be displaced back and forth perpendicular to the longitudinal axis 118 between a release position illustrated in FIG. 10 and a locking position illustrated in FIG. 11. The locking member 120 can be latched detachably with the plug-connection member 112 in the locking position by means of latch elements not shown in FIGS. 10 and 11.

Whereas in the case of the electrical plug connector 10 the mechanical connection between the first housing shell 48 and the plug-connection member 12 takes place by means of a pivoting movement, the mechanical connection between the first housing shell 48 and the plug-connection member 112 takes place by means of a linear translatory movement. In both cases, a mechanical connection can be achieved in a simple manner.

The invention claimed is:

1. An electrical plug connector, comprising:

a plug-connection member adapted to be plug-connected with a complementary plug-connection member in order to produce an electrical connection and which has a longitudinal axis, and a cable outlet member comprising a cable guidance channel, the cable guidance channel comprising a front channel section facing the plug-connection member and oriented in alignment with the longitudinal axis of the plug-connection member and a rear channel section remote from the plug-connection member and oriented at an angle to the longitudinal axis of the plug-connection member, the cable outlet member adapted to be connected detachably to the plug-connection member in a plurality of orientations, a plurality of first connecting elements located diametrically opposed to one another in pairs, the pairs of the first connecting elements being positioned on an end face of the cable outlet member facing the plug connection member, and two second connecting elements located diametrically opposed to one another and being positioned on the plug-connection member, in each of the plurality of orientations of the cable outlet member, one of the pairs of the first connecting elements are adapted to be connected detachably to the second connecting elements, wherein the cable outlet member is adapted to be connected detachably to the plug-connection member by a pivoting movement about a pivot axis arranged obliquely or perpendicular to the longitudinal axis of the plug-connection member or by a linear movement along the longitudinal axis of the plug-connection member.

2. An electrical plug connector according to claim 1, wherein the rear channel section is oriented at an angle of at least 45° to the front channel section.

3. An electrical plug connector according to claim 1, wherein the first connecting elements are spaced apart from each other.

4. An electrical plug connector according to claim 1, wherein the second connecting elements are spaced apart from each other.

5. An electrical plug connector according to claim 1, further comprising at least one locking member for detachably locking the cable outlet member on the plug-connection member.

6. An electrical plug connector according to claim 5, wherein the at least one locking member is mounted so as to be pivotable about a further pivot axis oriented obliquely or perpendicular to the longitudinal axis of the plug-connection member or so as to be linearly displaceable perpendicular to the longitudinal axis of the plug-connection member.

7. An electrical plug connector according to claim 5, wherein the at least one locking member is mounted on the plug-connection member.

8. An electrical plug connector according to claim 5, wherein the at least one locking member is adapted to be latched in a locking position.

9. An electrical plug connector according to claim 1, wherein the first connecting elements are configured as connection lugs and the second connecting elements are configured as connection receptacles, with one of the pairs of connection lugs being able to be introduced into the connection receptacles in each of the plurality of orientations of the cable outlet member.

10. An electrical plug connector according to claim 9, wherein the connection lugs protrude from the end face of the cable outlet member and are oriented parallel to the longitudinal axis of the plug-connection member.

11. An electrical plug connector according to claim 9, wherein the connection receptacles are arranged on an inner side of a collar of the plug-connection member which faces the cable outlet member.

12. An electrical plug connector according to claim 9, wherein the connection receptacles are formed in a shaft-like manner in a collar of the plug-connection member which faces the cable outlet member.

13. An electrical plug connector according to claim 9, wherein each of the connection lugs have an aperture, and a projection is arranged in one of the connection receptacles, which projection, upon introduction of one of the connection lugs into the connection receptacle, penetrates into the aperture of the connection lug.

14. An electrical plug connector according to claim 9, further comprising at least one locking member for detachably locking the cable outlet member on the plug-connection member, wherein the at least one locking member comprises a bar which is adapted to be introduced into one of the connection receptacles.

15. An electrical plug connector according to claim 9, wherein one of the connection receptacles has a delimitation in the form of a circular arc.

16. An electrical plug connector according to claim 1, wherein the cable outlet member has a first and a second housing shell, the first housing shell is adapted to be connected detachably to the plug-connection member in the plurality of orientations and the second housing shell being movable between an open position which releases the first housing shell and a closed position which covers the first housing shell.

17. An electrical plug connector according to claim 16, wherein the second housing shell is mounted on the first housing shell so that it is movable back and forth between the open position and the closed position.

18. An electrical plug connector according to claim 16, wherein the second housing shell is pivotable about a further pivot axis oriented obliquely or perpendicular to the longitudinal axis of the plug-connection member.

19. An electrical plug connector according to claim 16, wherein the cable outlet member has a cap nut which is adapted to be screwed onto the two housing shells.

* * * * *